US006499194B1

(12) United States Patent
Gresser et al.

(10) Patent No.: US 6,499,194 B1
(45) Date of Patent: Dec. 31, 2002

(54) ADJUSTING DRAWFRAME

(75) Inventors: Götz Theodor Gresser, Winterthur (CH); Christian Müller, Winterthur (CH); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/719,274

(22) PCT Filed: Jun. 11, 1999

(86) PCT No.: PCT/CH99/00255

§ 371 (c)(1),
(2), (4) Date: Mar. 19, 2001

(87) PCT Pub. No.: WO99/66113

PCT Pub. Date: Dec. 23, 1999

(30) Foreign Application Priority Data

Jun. 12, 1998 (CH) ..... 1277/98
Dec. 18, 1998 (CH) ..... 2507/98

(51) Int. Cl.[7] ..... D01H 5/32
(52) U.S. Cl. ..... 19/239; 19/240
(58) Field of Search ..... 19/238, 65 A, 19/105, 150, 152, 157, 159 R, 236, 237, 239, 240, 260, 261, 288, 291, 292, 258; 700/130, 139, 142, 143, 144

(56) References Cited

U.S. PATENT DOCUMENTS 4,199,844 A * 4/1980 Goetzinger ..... 19/240
4,369,550 A * 1/1983 Meile ..... 19/240
4,653,153 A * 3/1987 Felix et al. ..... 19/240
4,703,431 A * 10/1987 Sako et al. ..... 19/240
4,812,993 A * 3/1989 Konig et al. ..... 19/239
4,819,301 A * 4/1989 Konig et al. ..... 19/240
5,018,248 A * 5/1991 Haworth et al. ..... 19/240
5,463,556 A * 10/1995 Denz ..... 19/236
5,509,179 A 4/1996 Mondini et al.
5,583,781 A * 12/1996 Denz et al. ..... 19/236
5,771,542 A * 6/1998 Dammig ..... 19/239
5,796,635 A * 8/1998 Dammig ..... 19/239
6,088,882 A * 7/2000 Leifeld ..... 19/239

FOREIGN PATENT DOCUMENTS

DE 4215682 12/1992

OTHER PUBLICATIONS

PCT International Search Report, Sep. 27, 1999.

* cited by examiner

*Primary Examiner*—Danny Worrell
*Assistant Examiner*—Gary L. Welch
(74) *Attorney, Agent, or Firm*—Dority & Manning

(57) ABSTRACT

The invention relates to a method for controlling the draft of a fiber mixture (e.g. a sliver) of a textile machine, with sensors being provided which detect the fluctuations in mass of the fiber mixture which is supplied to a drafting arrangement unit including at least one changeable drafting zone which compensates the fluctuations in mass. A delay time is provided in order to take into account the running time of the fiber mixture from the measuring sensor up to a control application point. A method is therefore proposed whereby, for the purpose of changing certain control parameters, the delivery speed of the fiber mixture and/or the comparison of the measured progress of the mass of the fiber material supplied by the drafting arrangement unit with a predetermined setpoint progress of mass (setpoint) are used.

48 Claims, 5 Drawing Sheets

Delivery Speed

ADJUSTING DRAWFRAME

BACKGROUND

The invention relates to a method or an apparatus for controlling the draft of a fiber mixture (e.g. of a sliver) of a textile machine, with means being provided to detect the fluctuations in mass of the fiber mixture which is supplied to the drafting arrangement. A changeable drafting zone compensates the fluctuations in mass and is provided with a delay time in order to take into account the running time of the fiber mixture from the measuring means to a control application point.

Prior literature ("Feedback control systems in modern sizing machines" by Prof. Burgholz—Textilpraxis 1963, July, p. 643) shows a drafting arrangement in which fluctuations in the mass of fiber material supplied to the drafting arrangement are detected by way of a measuring element. The movement of the measuring roller which is produced by the fluctuations in mass is stored via a mechanical storage element and is transmitted in a time-delayed manner to a mechanical device for influencing the draft quantity. A time delay for the control intervention is thus achieved in a mechanical manner, which intervention takes the distance between the measuring place and the actual control application point for the evening of the fiber mixture into account.

In newer devices, as have been described in DE-A1-36 19 248 for example, this intermediate storage of the signal of the measuring element is performed electronically. This cited publication states further that the time of delay is corrected according to the magnitude and type of the measured fluctuation in the mass, which means that as soon as the signal of the measured fluctuations in mass is located outside of the normal fluctuations of mass, the draft intervention will occur earlier. This reduces the distance between the control application point and the measuring location of the measuring element. This device allows in particular an improved compensation of sudden fluctuations in the mass of a sliver.

EPA-A2-803 596 further proposes an apparatus and method for the direct determination of set-points for the control application point of a draw frame. Several measured values of a quality-characterizing value such as the CV value are used in order to determine the optimized parameter, such as the control application point in a test run. This optimized control application point is to remain substantially unchanged during the operation. This method, which uses the CV value, leads to disadvantages particularly when the textile machine which is situated upstream of the drafting arrangement is supplied with only one untwisted sliver which shows relatively large fluctuations in mass.

An apparatus is further known from EP-A1 533 483, with influencing quantities which influence the measured signal of the measuring member being detected by a fuzzy logic control device and being linked to a knowledge base. A corrective value for the measured signal is produced therefrom. The delivery speed of the fiber material supplied by the drafting arrangement can be used as an influencing quantity for example. This means that the corrective value relates to the respective design of the determined measured value on the basis of influencing quantities and not to the determination of the control application point. For the purpose of correcting the control application point, it is proposed in this embodiment that a signal analysis is performed at the drafting arrangement output on the basis of the analysis of the response signal of the measuring element, thus enabling the performance of respective interventions. This means that a correction of the control application point will only be performed at a time when the flaw in the fiber material has already passed through the drafting arrangement and thus can no longer be corrected. Moreover, a further measuring element is required at the output of the drafting arrangement, as well as a complex fuzzy logic control device.

A device shown in DE-A1 42 15 682 in which a correction of the control application point is performed according to a specific method. The method for the correction of the control application point is only started when there is a transient signal in the measuring element before the drafting arrangement which exceeds a predetermined tolerance value. With the help of the response signal which is detected by a measuring element at the output of the drafting arrangement, a respective intervention is performed via the control unit comparison with the transient signal in order to correct the control application point. This system is not continuously in operation and additionally requires a measuring element at the output of the drafting arrangement. Moreover, a correction of the control application point is only performed when the sliver containing the flaw has already left the drafting arrangement.

Examinations have shown that the evenness of the formed sliver, or the CV value and the spectrogram image, changes once the fiber material is supplied to the draw frame at different delivery speeds. This means that one has noticed that the control application point between the two pairs of drafting rollers changes in its position depending on the delivery speed. This fact is usually not disadvantageous in "pure draw frames", because these machines are usually operated with substantially constant speeds.

This fact is usually not disadvantageous in "pure draw frames", because these machines are usually operated with substantially constant speeds.

If such a drafting arrangement unit is arranged downstream of a carding machine for further processing of the card sliver, major delivery fluctuations in the drafting arrangement must be expected as a result of the operating procedure in the carding machine. These delivery fluctuations in the carding machine are caused by changes in production, running down the machine during changes of the cans, running in new clothings, and other circumstances. As a result of this frequent change of the delivery speeds, there is also a displacement of the control application point with respect to the measuring place before the drafting arrangement. This leads to maintaining an adverse sliver quality in respect to sliver regularity (CV value) and the spectrogram image.

This fact is also not considered, or only partly with limitations, by the apparatuses mentioned in connection with the state of the art.

Various devices are further known from the state of the art, e.g. from EP-A1176 661, with the regulation of an autoleveller draw frame begin performed on the basis of inlet and outlet measuring element in conjunction with a predetermined setpoint value. In the exhibited example, the signal for influencing the control parameters which is measured at the output is used for overall amplification and the runtime of the controlling electronic system. This device is to be used in particular to correct abrupt changes in the supplied fiber mass. This device relates to the matching of the control parameters during the drafting process and not to any principal setting of the control intensity or calibration of the drafting arrangement.

Insofar as such drafting arrangement operates autonomously as a draw frame, it was common practice up until now to make respective settings of the control parameters on the draw frame by sliver tests which were performed in a stationary manner in the laboratory. The determined fluctuations in mass were determined in comparison with a predetermined setpoint value (sample sliver) and respective interventions in the control parameters on the drafting arrangement were made. The stopping and renewed start-up of the draw frame to perform such tests and for setting the draw frame did not have any major influence on the productivity or efficiency of the unit.

As soon as this drafting arrangement is operated in direct connection with an upstream textile machine (e.g. a carding machine), such sliver tests performed in the lab are not easily possible without reducing the overall efficiency of the entire system. This means that as soon as the sliver tests are performed in a stationary manner in the laboratory, it is also necessary to stop the textile machine which is upstream of the drafting arrangement during these tests. When the textile machine concerns a carding machine, it is relatively problematic to put this machine with its relatively large moved masses back into operation again. This means that the efficiency of the system decreases.

A device is further known from DE-A1196 15 947 in which a function is determined on the basis of several CV values whose minimum leads to an optimized parameter such as a control application point or amplification for the control of the draw frame or the carding machine. The optimized parameter is determined in a pre-operational test or setting run of the draw frame or carding machine and maintained during operation in a substantially unchanged way.

It is now an object of the present invention to provide a method and an apparatus for setting the drafting arrangement in order to perform optimized control interventions by considering maintaining a high efficiency of the entire plant, particularly when a textile machine is provided directly upstream of the drafting arrangement for the purpose of supplying fiber material. Additional objects and advantages of the invention will be set forth in the following description, or may be obvious from the description, or may be learned through practice of the invention.

This object is achieved on the one hand in such a way that, for changing certain control parameters, the delivery speed (LG) of the fiber mixture (7) and/or the comparison between the measured course of the mass of the fiber material (Fi) supplied by the drafting arrangement with a predetermined setpoint course of the mass (setpoint) is/are used.

The term "delivery speed" relates to the speed of the fiber material which is supplied to the drafting arrangement. The measuring element for detecting the fluctuations in mass is located before the entrance to the drafting arrangement as seen in the direction of conveyance.

This device allows that the control intervention is performed at an optimal time, or in an optimized magnitude, in order to completely compensate any fluctuation in mass as determined by the measuring element.

The drafting arrangement could be provided with merely one drafting zone (single-zone drafting arrangement) or with several drafting zones (e.g. preliminary draft and main draft).

It is preferably proposed that the position of the control application point to the measuring element is corrected depending on the delivery speed of the fiber mixture.

It is further proposed that the change in the position of the control application point is performed on the basis of a curve as predetermined by the control unit. This curve was produced first manually on the basis of experimental values and test results and was used by the control unit to determine a corrective value. The curve is determined on the basis of the values (distance of the control application point to the measuring place) and the delivery speed of the fiber material supplied to the drafting arrangement.

If a machine (e.g. a carding machine) is provided upstream of the drafting arrangement which supplies the produced fiber material (e.g. the sliver) to the downstream draw frame, it is advantageous to integrate this curve in the control unit of said upstream machine in order to determine the correction of the position of the control application point. This is advantageous because the delivery speed of the supplied fiber material is known to said machine or its control unit or has already been determined there.

It is further proposed that the distance of the control application point from the measuring element is reduced with rising delivery speed.

For the purpose of considering different fiber materials, it is proposed that several curves can be selected in the control unit according to the selected fiber material. Depending on the fiber feed (staple, mixture, etc.), the drafting characteristics change in the drafting characteristics change in the drafting arrangement and thus also the position of the control application point.

In order to avoid unnecessarily burdening the regulating device in case of minor fluctuations of the delivery speed, it is proposed that the change in the position of the control application point is only performed when the delivery speed of the fiber mixture leaves a predetermined tolerance threshold.

It is further proposed that when comparing the measured course of the mass of the fiber material as supplied by the drafting arrangement with a predetermined setpoint course of the mass (setpoint), the deviations which exceed the tolerance value are used for changing the control parameters.

The setting of the control intensity is to be understood as the control parameter in particular, which intensity characterizes a value by which the draft is changed into a setpoint mass on the basis of a measured differential signal of the output mass (mean value of the supplied fiber mass). The intervention made on the drafting quantity is to be dimensioned in such a way that the actual value is brought back to the setpoint value.

It is preferably further proposed that the course of the mass is depicted in the form of a spectrogram which is compared with a standard spectrogram which is predetermined to the control unit. The "term" compared shall be understood in such a way that the determined spectrogram is placed in the control unit by a control program (software) over the standard spectrogram, with the deviations determined from the contour of the standard spectrogram being determined and evaluated via a respective electronic evaluation system. This evaluation device can be used in particular to determine any occurring "peaks" and/or "chimneys" of the actual spectrogram as compared with the standard spectrogram. These evaluations can be used to take measures manually or automatically following the evaluation of the respective progress of the contour of the spectrogram in order to change the control parameters or settings in such a way that on the one hand the determined "peaks and or chimneys" are avoided and on the other hand the contour of the actual spectrogram approaches the contour of the standard spectrogram or is brought close to a matching. A tolerance field can be provided which allows upward and downward deviations from the course of the standard spectrogram without performing any interventions in the control parameters (e.g. the position of the control application point). This prevents any "build-up process" of the control system.

The measures for changing the control parameters can comprise the following: adjustment of the control intensity, i.e. the determination of the magnitude of the change in draft on the basis of a determined differential signal between actual and setpoint value (mean value of fiber mass); displacement of the control application point to the one or other side; increase of the pressing pressures of the drafting rollers; and change of the drafting distance and further measures. The choice of the measure is made on the basis of the evaluation. The control can be based on a catalog of measures (expert system).

The measures for changing the control parameters can comprise the following: Adjustment of the control intensity, i.e. the determination of the magnitude of the change in draft on the basis of a determined differential signal between actual and setpoint value (mean value of fiber mass), displacement of the control application point to the one or other side, increase of the pressing pressures of the drafting rollers, change of the drafting distance and further measures. The choice of the measure is made on the basis of the evaluation. The control can be based on a catalog of measures (expert system).

Preferably, the spectrogram deviations will be used in the range of between 5 and 150 cm period lengths for the measuring process. It is possible with this device to perform purposeful optimizations of the control device without requiring any running down of the upstream textile machine (carding machine) and with simultaneously compensating internal tolerances within the control device.

A method is further proposed in which the course of the mass is depicted as a mean value which is compared with a predetermined setpoint value. In particular, this device allows an optimal setting of the control intensity, so that the fluctuations in mass which deviate from the setpoint mean value are returned completely to said value.

Measures for the correction of the control devices can be a displacement of a control application point to either the one or the other side, or the adjusting quantity of the draft on the basis of a determined differential signal between an actual and a setpoint value.

In order to calibrate the effectiveness of the control device with respect to any upward or downward deviation from the setpoint mean value, it is proposed that for setting the control parameters the fiber mass supplied to the drafting arrangement is changed per measuring interval. This means that for an evaluation process, the drafting arrangement unit is supplied with an increased fiber mass and with a lower fiber mass for a further measuring process. An error in the mass is intentionally produced in this method by the machine (or apparatus) upstream of the drafting arrangement unit in order to check, or possibly correct, the effectiveness of the control intensity.

In addition to the evaluation of the spectrogram with respect to the standard spectrogram, the determined coefficient of variation (CV value) can be used which is compared with a predetermined CV value of the setpoint course of the mass. The length CV value can be used with a length of cut of between 20 cm and 3 m.

In order to correct the deviation in the mass (occurring peaks in mass), the displacement of the control application point can be used.

Preferably, the fiber mixture is supplied by a carding machine of the drafting arrangement unit.

To ensure that the adjustment of the control parameters also meets the needs of the conditions during the working operation, it is proposed that during the run-up of the carding machine a warm-up period is set during which certain monitorings performed by the control unit are ceased. This also relates to such monitorings which measure the course of the mass of the fiber mixture in the drafting arrangement. This means that an adjustment of the control parameters can only be performed following the expiration of the warm-up function. In the cold state, the working units via which and between which the fiber material is conveyed has different processing characteristics which correspond not necessarily to the conditions during operation. Cold rollers can have the tendency for example to extract fibers from fiber material. This could lead to fluctuations in the mass, however, which are caused merely by the system per se. That is why the calibration of the control devices should be performed under operating conditions, i.e. after the completion of the warm-up phase. After the completion of this phase, a length counter can be activated which is provided to supply information about the production. The material produced during the warm-up phase can be deposited in a separate can. This separately stored material can be returned to the blowroom for reprocessing.

An apparatus according to the invention may be provided with means by which the position of the control application point to the measuring element is determined on the basis of the delivery speed of the fiber mixture.

The invention is further solved by an apparatus, with means being provided with which the position of the control application point to the measuring element is determined on the basis of the delivery speed of the fiber mixture.

These means are preferably formed by a control device, in particular a microcomputer, which causes the initiation of the change in the draft on the basis of data deposited and stored in the control device in conjunction with signals which are transmitted to the control device by a measuring element for the detection of the delivery speed of the fiber material.

It is further proposed that the fiber material is supplied from a carding machine to a downstream drafting arrangement unit. The control unit of the carding machine is provided with means in order to transmit a corrective signal to determine the position of the control application point of the downstream drafting arrangement to the control unit of the drafting arrangement to initiate the change in the draft.

An apparatus of the invention may have at least one further means provided in order to detect the course of the mass of the fiber material as supplied by the drafting arrangement unit. The signals of the means are transmitted to the control unit which determines the deviations on the basis of a predetermined setpoint value and produces control signals according to the deviations in order to change certain control parameters.

Preferably, the textile machine can be a carding machine.

It is further proposed that for setting the control parameters (control intensity) the quantity of the supplied fiber mass is varied by the carding machine for different measurement periods.

The speed of the feed roller to the carding machine can be constant and the speed of the doffer can be changed via the control unit.

It is similarly possible to change the speed of the feed roller to the carding machine via the control unit and to keep the speed of the doffer constant.

In both cases the carding machine will supply more or less fiber material to the downstream drafting arrangement unit following the change of speed. The effects of these different supply quantities with respect to the setting of the control parameters have already been described in the details on the method claims.

In order to adjust the measuring periods to the differently supplied fiber quantity, it is provided to use a timing element in order to consider the delay time between the start of the changed delivery quantity and the time at which the changed delivery quantity is processed in the drafting arrangement unit. The timing element can be considered within the scope of a software component in the control unit.

As has already been described above in closer detail, it is proposed that during the run-up of the carding machine a warm-up function for the machine is initiated in the control unit which cuts off certain means for monitoring and/or controlling.

DESCRIPTION OF DRAWINGS

Means for monitoring the warm-up phase have been provided which are used to release the performance of the adjustment of the control parameters. These means can be temperature sensors which are attached to the carding machine or the drafting arrangement unit. Preferably, the attachment of these sensors is made to the drafting arrangement unit, because it usually has a longer warm-up phase than the carding machine.

Further advantages are shown and explained in closer detail by reference to the following embodiments, wherein.

Figure 1:
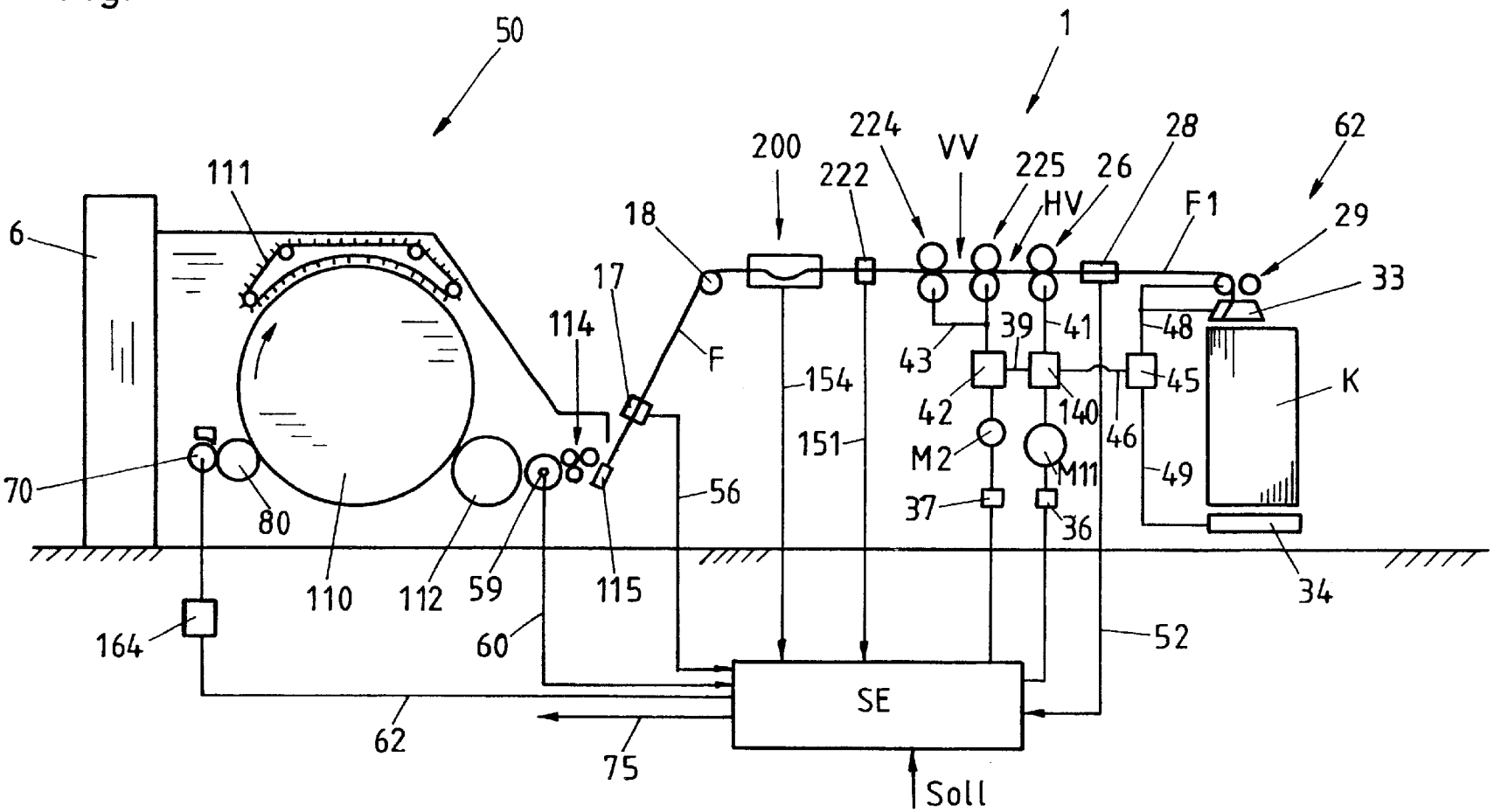
FIG. 1 shows a schematic side view of a card with a downstream drafting arrangement unit.

Reference will now be made in detail to embodiments of the invention, one or more examples of which are shown in the drawings. Such embodiments are provided by way of explanation of the invention, and not as a limitation of the invention. It should be apparent that modifications and variations can be made to the described embodiments without departing from the scope and spirit of the invention.

FIG. 1 schematically shows a carding machine 50 which is provided downstream with a drafting arrangement unit 1 (referred to hereinafter as drafting arrangement) and a sliver coiler 62. The carding machine 50 is provided with a filling box 6 through which the fiber material is supplied to feed roller 70. The feed roller 70 transfers the fiber material to the downstream licker-in 80 from where the fiber material is supplied to the downstream swift 110. The swift 110 is provided with clothings (not shown in closer detail) which cooperate with clothings of a revolving flat 111 which is arranged above the swift 110.

Figure 2:
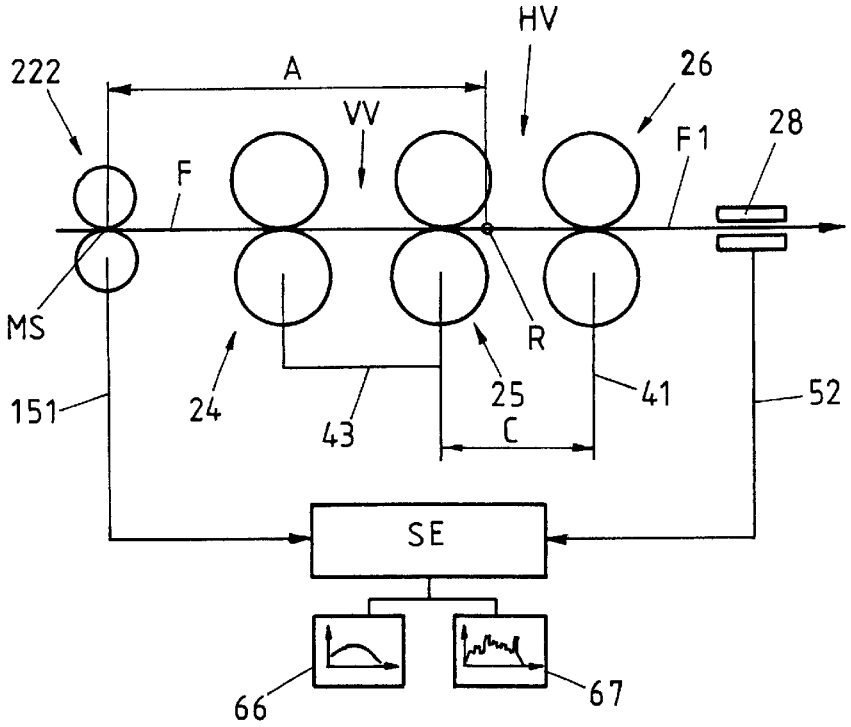
FIG. 2 shows a schematic partial view of a drafting arrangement unit with the illustration of the control application point.

The prepared fiber material then reaches the zone of a doffer 112 where it is removed and reaches a downstream transverse conveyor belt 115 via conveyor rollers 114. The nonwoven supplied by the conveyor rollers 114 to the transverse conveyor belt 115 is formed into a sliver F by the transverse movement of the transverse conveyor belt 115 and transferred to the drafting arrangement 1 by way of the deflection roller 18. In this process, the sliver F passes a sensor 17 downstream of the transverse conveyor belt 115 which is in connection with a control unit SE via line 56. The sensor 17 can be equipped with stepped rollers which determine the sliver mass and transmit a signal to the control unit SE. This signal is used for long-term control of the carding machine 50, with a control being applied on the speed of the feed roller 70 which is driven with the drive path 62 and the gear 164. Output from control unit SE can also exit via line 75. A sliver storage 200 and a measuring element 222 are arranged between the deflection roller 18 and the drafting arrangement 1. The sliver storage 200 is used for compensating differences between the delivery speed of the carding machine and the feed speed of the drafting arrangement which are produced by the control interventions in the inlet zone of the drafting arrangement 1. The sliver storage 200 is connected to the control unit SE with a line 154 through which the degree of filling (e.g. the sag of the sliver loop) in the storage unit 200 is transmitted to the control unit SE. Monitoring sensors (not shown in closer detail) in the storage unit 200 are provided for this purpose. The sensor 222 could be equipped with a pair of sensing rollers for example (as shown in FIG. 2), with at least one of the rollers being movably held to scan the sliver mass. The scanned signal is then supplied to the control unit SE via the line 151.

The prepared fiber material then reaches the zone of a doffer 112, it is removed there and reaches a downstream transverse conveyor belt 115 via conveyor rollers 114. The nonwoven supplied by the conveyor rollers 114 to the transverse conveyor belt 115 is formed into a sliver F by the transverse movement of the transverse conveyor belt 115 and transferred to the drafting arrangement 1 by way of the deflection roller 18. In this process the sliver F passes a sensor 17 downstream of the transverse conveyor belt 115 which is in connection with a control unit SE via line 560. The sensor 17 can be equipped with stepped rollers which determine the sliver mass and transmit a signal to the control unit SE. This signal is used for long-term control of the carding machine 50, with a control being applied on the speed of the feed roller 70 which is driven with the drive path 62 and the gear 164. A sliver storage 200 and a measuring element 222 are arranged between the deflection roller 18 and the drafting arrangement 1. The sliver storage 200 is used for compensating differences between the delivery speed of the carding machine and the feed speed of the drafting arrangement which are produced by the control interventions in the inlet zone of the drafting arrangement 1. The sliver storage 200 is connected to the control unit SE with a line 154 through which the degree of filling (e.g. the sag of the sliver loop) in the storage unit 200 is transmitted to the control unit SE. Monitoring sensors (not shown in closer detail) in the storage unit 200 are provided for this purpose. The sensor 222 could be equipped with a pair of sensing rollers for example (as shown in FIG. 2), with at least one of the rollers being movably held to scan the sliver mass. The scanned signal is then supplied to the control unit SE via the line 151.

The drafting arrangement 1 substantially consists of two drafting zones, the preliminary drafting zone W and the main drafting zone HV. The preliminary drafting zone W is formed by the pairs of rollers 224 and 225 which are fixedly coupled with one another by way of the drive path 43 which is shown schematically. This means that the speed ratio (draft ratio) between the pairs of rollers 224 and 225 is fixedly set. The main drafting zone is situated between the pairs of rollers 225 and 26, with the pair of rollers 26 which is driven by a motor M11 via the gear 140 and the drive path 41 is driven at a constant speed. The motor M11 is driven by the control unit SE via a frequency converter 36. The gear 140 is connected via a drive path 39 with a differential gear 42 which can be overdriven by a servo-motor M2. The servo-motor M2 is controlled by the control unit SE via a frequency converter 37. The change in the speed of the pairs of rollers 224 and 225 with respect to the constant speed of the pair of rollers 26 is performed via the gear 42 and the drive path 43 insofar as a control intervention is required. The sliver F1 formed at the outlet of the drafting arrangement 1 passes through a sensor 28 and reaches the can K via the calender rollers 29 and the funnel wheel 33 where it is deposited in the form of a loop. As is shown schematically, the drive of the calender rollers 29 and the funnel wheel 33 is performed via the drive path 48 which is driven by a gear 45, which on its part is operatively connected with the gear 140 via the drive connection 46. The can plate 34 is also driven by the gear 45 via the drive path 49. As a result of this drive sequence, the drive of the pair of output rollers 26 is coupled with the drive of the can coiler 62 at an evenly remaining drive ratio.

The compensation of fluctuations in mass which are transmitted by the sensor 222 to the control unit SE is performed by changes in the speed of the pairs of rollers 224 and 225 through the servo-motor M2, thus changing the draft in the main drafting zone HV. In order to determine the deviations in the mass, a setpoint value (setpoint) is used in the control unit SE which is compared with the actual value. The differences derived therefrom initiate the described control process.

As is shown in FIG. 2 in particular, the measuring point MS in the pair of sensing rollers 222 is spaced at a distance A from the control application point R. The control application point R is a fictitious point and represents the point at which the control intervention should occur from a temporal point of view in order to compensate the deviation in mass as determined at the measuring point MS.

Figure 3:
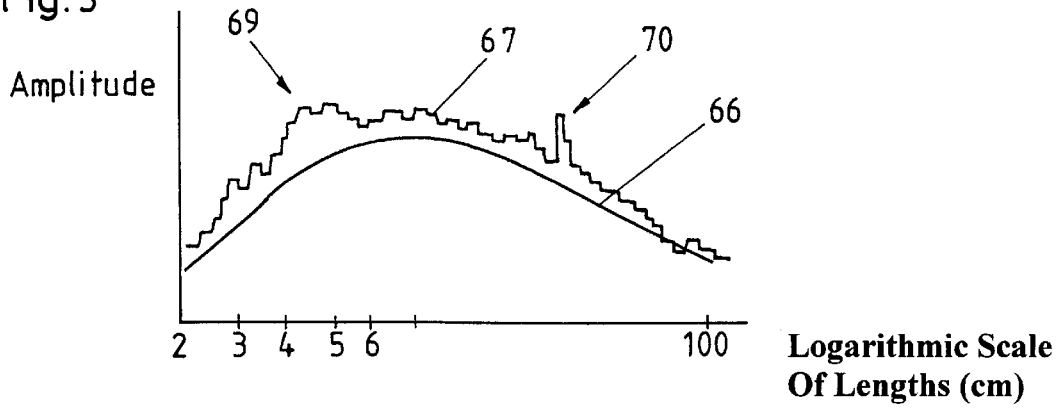
FIG. 3 shows a spectrogram representation.

Practical operation has shown that the position of the control application point which is representative of a control parameter depends on several factors. Tolerances within the control system or within the drafting arrangement units also play a role. Furthermore, the level of the pressure load of the press rollers of the pairs of rollers 224 to 26 play a role in the compensation. Similarly, the distance C between the pairs of rollers 225 and 26 must be set accordingly for optimal compensation. Furthermore, the intervention made in the draft quantity on the basis of the determined differential signal between actual and setpoint value represents an important control factor. It is important to include the resulting differential value in such a way in the change of draft so that a complete compensation of the deviation in mass can be achieved. This means that the evaluation of the determined differential signal and the implementation for the intervention in the draft quantity is of decisive relevance for the result of the control work. This shows that many factors must be considered in order to perform the control work, so that the produced sliver F1 is provided with close to the same quality as a setpoint value sliver. It is therefore necessary to consider the aforementioned factors and to calibrate the autoleveller unit according to the present system. For this purpose a curve of a standard spectrogram 66 is stored in the control unit SE which was formed from a sliver which can be realized from a technical viewpoint and is free from any flaws. The sensor 28 (which can be an inductive sensor for example) is used to determine the spectrogram of the sliver F1 in conjunction with the control unit SE which is shown schematically as 67. Output from sensor 28 is fed by line 52 into control unit SE. These two spectrograms 66 and 67 are placed over one another by software routines, thus leading to the illustration according to FIG. 3. This shows that the actual spectrogram 67 progresses in this case above the curve of the normal spectrogram. Furthermore, conspicuous elevations can be seen at two places, with the first elevation being designated as peak 69 and the second elevation as chimney 70 represents a periodic error.

On the basis of this evaluation, respective control parameters such as the distance A are changed and a further measurement is performed thereafter. Depending on the evaluation of the deviations from the standard spectrogram, respective interventions in the control parameters can be performed (as described above) in order to perform further measurements subsequently. It is possible to store a catalog of flaws in the system, thus leading to the respective intervention in the control parameters. These adjustments are made until a satisfactory result of the actual spectrogram with respect to the standard spectrogram is obtained. In addition to this spectrogram evaluation, it would also be possible to include the CV value into the consideration for setting the control parameters as long as no satisfactory results can be achieved with the first method.

Figure 4:
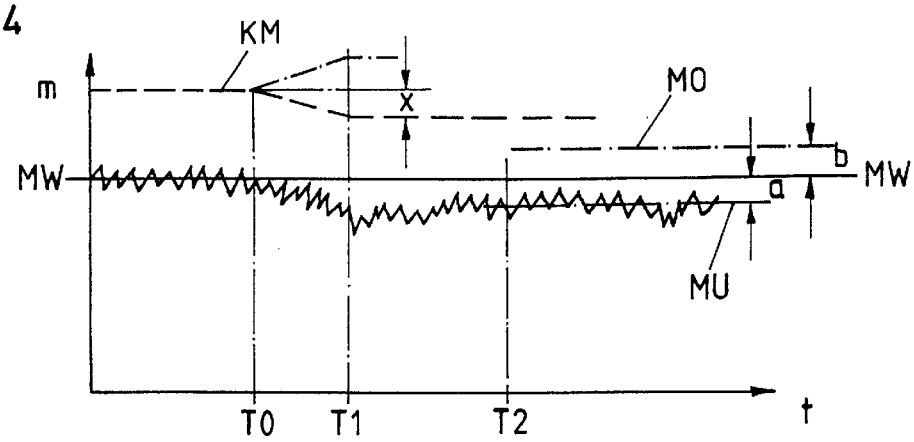
FIG. 4 shows a diagram for exhibiting the mean value of the fiber mass and the delivery quantity of the carding machine.

FIG. 4 shows a further possibility for adapting the control system. The sliver mass is based on the setpoint mean value MW. In particular, the method as described below can be used to check or set the control characteristics (control intensity) of the control device in case of upward or downward deviations in the predetermined fiber mass. For this purpose, several measuring periods are performed. In the exhibited example of FIG. 4, a reduced sliver mass (an intentionally produced flaw in the supplied fiber mass) is supplied to the drafting arrangement unit at time T1. Above the course of the mean value of the fiber mass, the broken line shows the fiber mass KM which is supplied to the drafting arrangement unit, with the fiber mass being reduced at time T0. At time T1 the supplied fiber mass has been reduced completely by the quantity X. From this time (T1) onwards the drafting arrangement unit is supplied with the fully reduced fiber mass.

The mean value of the reduced sliver mass decreases at first (below the setpoint MW) and is partly compensated in the shown example by the autoleveller device up to a mean value MU. This mean value MU shows a distance a from the setpoint mean value MW, which shows that the reduced sliver mass was not compensated completely by the autoleveller device. In this case too it is necessary to make settings (as described in the preceding example) in the control parameters in order to obtain the optimal compensation, i.e. the return to the desired mean value MW. The control intensity, i.e. the intervention in the draft quantity, can be changed for example. The intervention in the draft on the basis of the determined mass differential signal is modified or corrected accordingly. In a further measuring interval, the delivered quantity from the carding machine to the drafting arrangement can be increased (indicated with the dot-dash line in FIG. 4) and the result of the compensation can be verified and corrected by adjusting the respective control parameters. As is also shown with the dot-dash lines, a mean value MO with the distance b from the ideal mean value MW can be obtained, which also entails an adjustment of the control parameters (e.g. control intensity). In performing the different measurements with the different delivered quantities it is also possible to use different measuring lengths of the slivers for determining the mean value.

It is therefore possible, by changing the control intensity, by varying the distance A, by changing the axial distance C or by respectively changing the pressure load of the press rollers to perform an optimal setting of the control device.

In the illustrated example of FIG. 1, a temperature sensor 59 is attached to one of the rollers of the pairs of rollers 114, which sensor supplies its signal to the control unit SE via the line 60. This temperature sensor, which can also be attached at other locations within the carding machine 50, is used to monitor the warm-up function of the machine. This means that during the run-up of the machine (when the cylinders are still cold) various monitoring or control functions are deactivated until a temperature signal is sent by sensor 59 via line 60 which corresponds to a predetermined setpoint value. Only when that has occurred will the length counter for the produced material, the autoleveller device of the carding machine, or the downstream drafting arrangement unit 1 and the other monitoring devices be activated. It is necessary to consider that the drafting arrangement unit may require a longer warm-up phase than the carding machine, thus necessitating respective additional time requirements. In this case, the setting of the autoleveller device of the drafting arrangement unit can be performed then. The temperature sensors can also be attached to the drafting arrangement unit. The warm-up function is performed because material can adhere to the cold rollers and the other working members, thus not ensuring optimal operation. The rubber jackets of the press rollers have a different hardness in the cold state than in the warm state, thus leading to different technological preconditions in the drafting work and thus influencing the quality of the produced sliver. The material produced during the run-up phase (warm-up phase) can be deposited in a separate can and thereafter be returned to the blowroom for recycling in the processing process.

This device allows making respective calibrations without any laboratory tests during the full operation of the plant in order to perform an optimal setting of the autoleveller device so as to maintain the desired sliver quality. This ensures that the efficiency of the overall plant is maintained.

Figure 5:
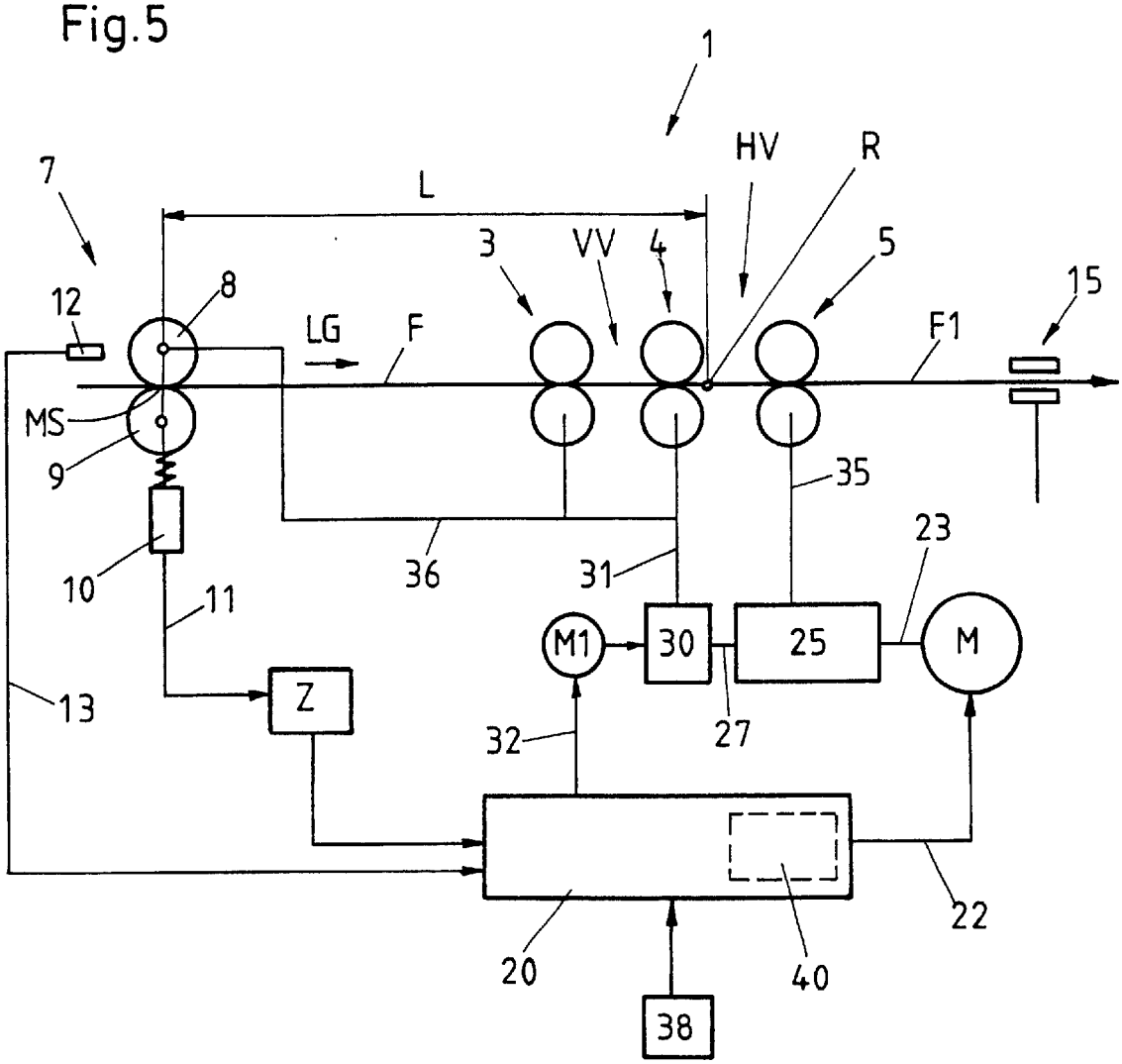
FIG. 5 shows a schematic representation of a drafting arrangement unit with an inlet measuring element.

FIG. 5 shows a drafting arrangement unit 1 which consists of two drafting zones, the preliminary drafting zone W and the main drafting zone HV. The preliminary drafting zone is formed by the successive pairs of rollers 3 and 4. the main drafting zone is formed by the pairs of rollers 4 and 5. In these pairs of rollers 3 to 5, the respective lower roller is provided with a drive device which will be described below in closer detail. The respective upper roller of said pairs of rollers is usually at rest in a pressure-loaded way on the lower rollers and are driven by way of friction. The drafting arrangement unit 1 is provided upstream with a measuring element 7 though which the sliver F is passed before it reaches the drafting arrangement unit. Instead of the single sliver F, it would also be possible to supply several slivers situated adjacent to one another.

The measuring element 7 consists of a stationarily held roller 8 which is also driven by way of a drive which will be described below in detail. Roller 8 is associated with a roller 9 which rests on roller 8 in a spring-loaded manner and is capable of performing evading movements in case of fluctuations in the mass of sliver F. These evading movements are detected in the measuring element 10 and supplied via a timing element Z to the control unit 20. In addition, a sensor 12 is associated with roller 8 which scans the actual speed of said roller and thus the delivery speed of the sliver F to the drafting arrangement unit 1. The signal of the sensor 12 is supplied via line 13 to the control unit 20. A further monitoring element 15 for the formed sliver F1 can be provided downstream of the drafting arrangement unit 1. Said monitoring element 15 is used in particular for monitoring the long-term drifting of the formed sliver and cuts off the machine when the sliver mass migrates outside of the predetermined tolerance range. The measuring element 7 monitors the short-term fluctuations in the sliver and initiates with its signal the control process for changing the draft in order to compensate or control the measured fluctuations in the mass.

Figure 6:
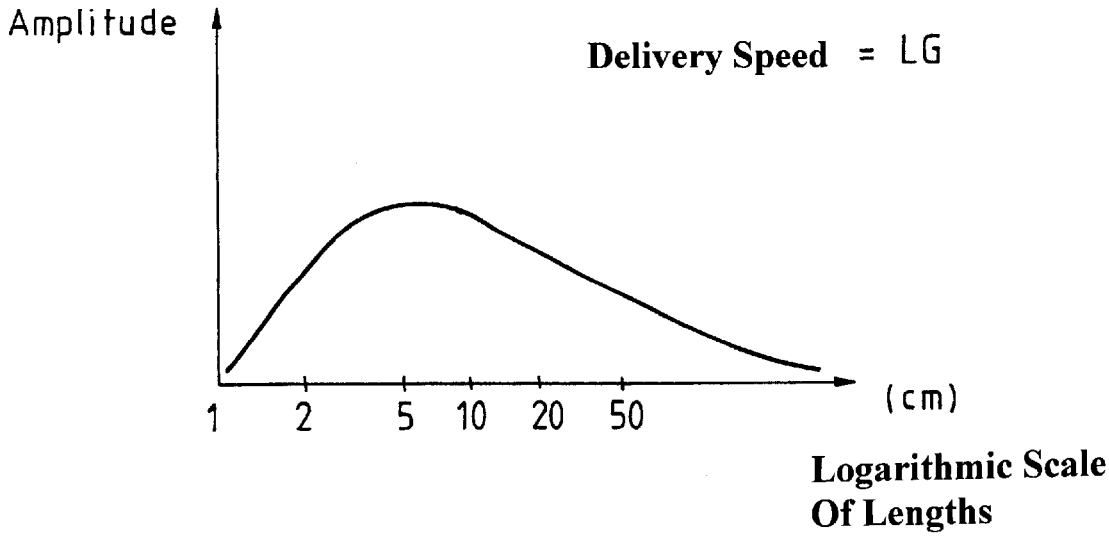
FIG. 6 shows a quality representation in the form of a spectrogram.

The control unit 20 controls a main motor M via line 22 achieve the optimal curve according to FIG. 6. The delay time until the control intervention is adjusted by the correction of the position of the control application point.

The forward pair of rollers 5 of the drafting arrangement 1 is driven by the main gear 25 via the drive path 35.

A setpoint value 38 which is predetermined to the control unit is shown schematically. It is predetermined and is used for setting the draft. The control application point R is situated between the pairs of rollers 4 and 5 at a distance L from the measuring place MS of the measuring element 7. The position of said control application point R determines the time at which the control intervention must be performed in order to compensate the fluctuation in mass as determined by the measuring element 7 by changing the draft.

The actual position of the control application point R depends on the technology of the drafting process and is usually located at a close distance from the rear pair of rollers 4 of the main drafting zone HV. Practical experience has shown that the position of said control application point R shifts in the case of changed delivery speed of the supplied fiber material and thus changed production. This was seen in particular during the production and evaluation of a spectrogram (representation of fluctuations of mass in the frequency range), as is shown for example in the FIGS. 6 to 8. In FIG. 6, the amplitude height is entered over a logarithmic scale of lengths (centimeter). This curve rises steeply until reaching a curve peak and then tapers off. This curve representation is designated as ideal and is desirable with respect to the evenness of the sliver.

Figure 7:
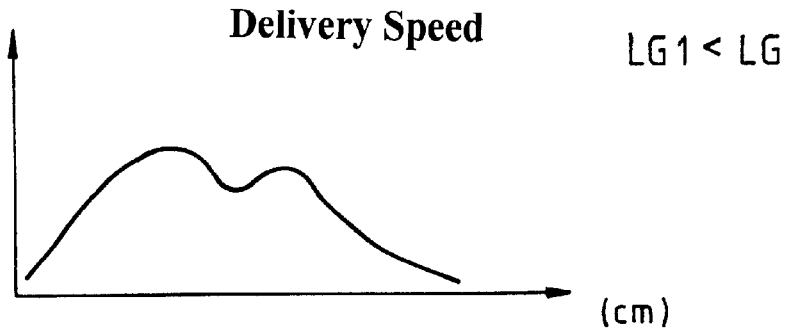
FIG. 7 shows a further spectrogram according to FIG. 6.

In the diagram according to FIG. 7 the delivery speed was reduced and the position of the control application point R to the position of the measuring location MS (distance L) was not changed. This means that merely the time was adjusted due to the lower delivery speed, which time has changed from the measuring location MS until reaching the fixed control application point R. This diagram of FIG. 7 shows that the curve now is provided with two elevations, which is indicative of an adverser quality of the formed sliver F1. This means that the evenness of sliver F1 is not constant and there are signs of periodic flaws.

Figure 8:
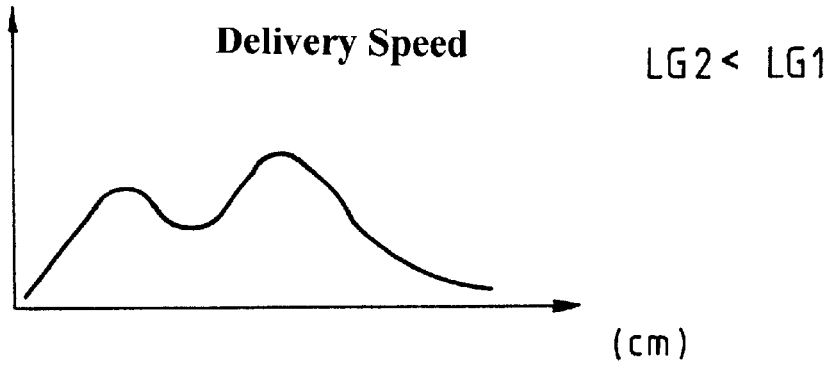
FIG. 8 shows a further spectrogram according to FIG. 6.

The diagram according to FIG. 8 shows a curve progress which is obtained during the further reduction of the delivery speed. It can be seen clearly that the second elevation of the curve now already projects beyond the first elevation. This leads to the result that the evenness of sliver F1 has deteriorated even further.

Experiments have shown that by changing the position of the control application point R with respect to the measuring location MS during the changed delivery speed LG it is possible to compensate the disadvantageous effects, as is shown in the diagrams according to FIGS. 7 and 8. This means that by changing the position of the control application point R at changed delivery speed LG it is possible to approximately achieve the optimal curve according to FIG. 6. The delay time until the control intervention is adjusted by the correction of the position of the control application point.

Figure 9:
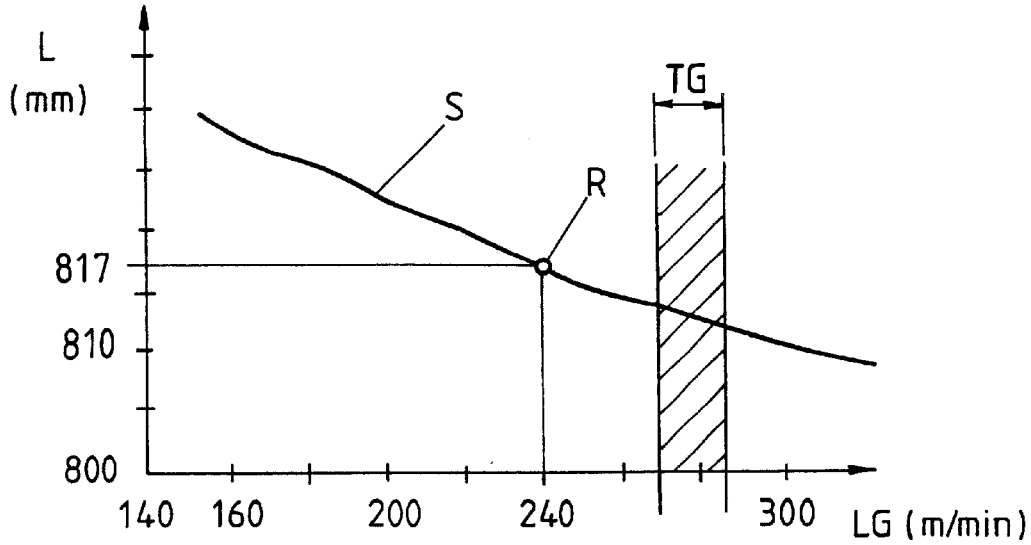
FIG. 9 shows a compensating curve for the control for the correction of the control application point.

The results of these examinations are shown in a diagram according to FIG. 9, with a curve S being shown which is entered over the delivery speed LG (meters per minute) and the length L (mm), with L representing the distance between the measuring location MS and the control application point R. On the basis of this diagram according to FIG. 9, which is schematically shown in FIG. 5 as table 40 in the control unit 20, the position of the control application point R can be determined according to the existing delivery speed LG. This leads to the time interval according to which the control intervention must be performed with respect to the measuring location MS. FIG. 9 also shows a tolerance field TG which characterizes a range of the delivery speed in which no correction of the control application point is performed.

This tolerance field TG is usually placed in the range of the delivery speed where the work is usually performed most of the time. The tolerance field is to prevent any "building-up process" or overload of the control system. This means that smaller fluctuations in the delivery about a standard value need not necessarily lead to ongoing corrections of the control application points, because they are negligible.

The curve S is usually entered with the beginning of the delivery speed=zero and covers the entire spectrum of the possible delivery speed. For the purpose of the run-up from the delivery speed=zero to the operating delivery speed, or in the opposite case for the running down to the delivery speed=zero, it would also be possible to designate certain special ranges in which no correction needs to be made.

The control system of the illustrated device will be explained and outlined again below in closer detail:

The drive system is set in such a way that the system is operated with a constant draft (different circumferential speeds of the pairs of rollers 4 and 5). The preliminary draft between the pairs of rollers 3 and 4 remains constant. Once any irregularity is determined in the sliver mass (thin or thick place) by means of the roller 9, it is detected via the measuring element 10 and delivered via line 11 to a timing element Z. The timing element/is usually integrated in the control unit 20 and forms a time delay factor on the basis of the delivery speed until the detected fluctuation in the mass reaches the control application point R and is compensated there by a change in the draft. This compensation of the fluctuation in the mass is performed by using the setpoint value 38 in the control unit 20 which emits a control signal 32 to the servo-motor M1 following the evaluation of the signal. Said motor M1 drives the control gear 30, thus changing the speed of the pair of rollers 4 and thus the draft quantity in the main drafting zone HV. This intervention allows compensating any thick or thin place in the sliver mass. As a result of the illustrated drive connection 36, the drive of the pair of rollers 3 and of the measuring element 7 is entrained according to the changed speed of the pair of rollers 4. As a result, the speed ratio between the pairs of rollers 7, 3 and 4 remain constant. The speed of the pair of rollers 5 which is driven via gear 25 and the drive strand 35 also remains constant. In order to allow setting the time delay precisely via the timing element Z, a sensor 12 is arranged which scans the precise speed of roller 8 of the measuring element 7 and transmits the same via path 13 to the control unit 20.

Once the delivery speed of the supplied sliver mass F changes, the control application point R is newly determined in a respective manner by way of the table 40 which is stored in the control unit 20. On the basis of this new determination of the position of the control application point R, the time delay until the actual intervention in the change of the draft is newly determined. Such fluctuations in the delivery speed are present in particular when the drafting arrangement unit is provided upstream with a carding machine in which such production fluctuations (fluctuations in delivery) by various events or measures are normal.

Figure 11:
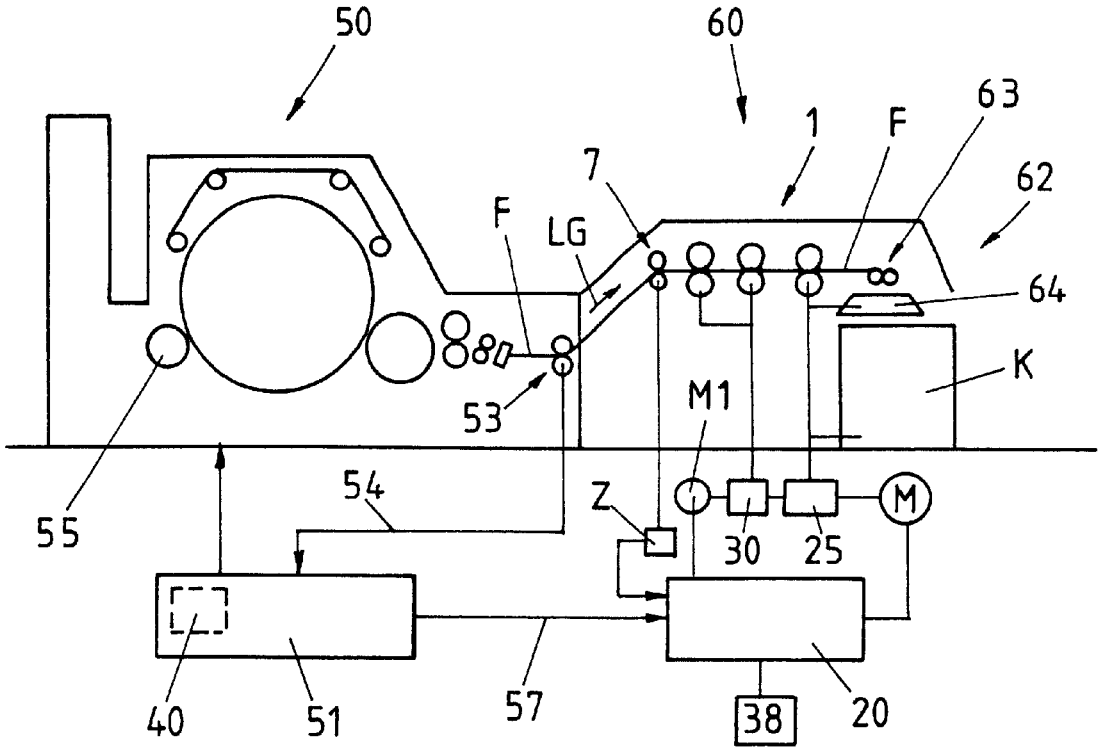
FIG. 11 shows a schematic side view of a card with a downstream drafting arrangement unit.

FIG. 11 schematically shows such a combination of a carding machine 50 with a downstream draw frame 60. The draw frame 60 is also provided with a drafting arrangement unit 1 which comprises a drive and control device as is described in FIG. 5 for example. In addition, said draw frame 60 is provided with a can coiler 62 in which sliver F1 is deposited in can K by way of calender rollers 63 and a funnel wheel 64. As is schematically indicated, the drive of said elements of the can coiler 62 is also taken from the main gear 25. This means that the drive between the can coiler and the forward pair of rollers 5 of the drafting arrangement unit 1 is at a constant ratio.

The carding machine 50 is controlled by way of a control unit 51, as is schematically indicated. The sliver F formed in the carding machine is guided through a pair of measuring rollers 53 which monitors the long-term drift of the sliver and transmits respective signals to the control unit 51 via a path 54. These signals are used substantially for controlling the feed roller 55. At the same time, a speed signal can be tapped from said measuring rollers 53 which is also transmitted to the control unit 51 via path 54. The control unit 51 uses this speed signal to determine the delivery speed LG of the sliver F and to compare it with table 40 which is also stored in the control unit 51. This comparison can then be used to determine from table 40 the actual position of the control application point R of the downstream drafting arrangement unit 1 and to send the same to the control unit 20 via the path 57. This means that the machine(carding machine) which is relevant for the level of the delivery speed also supplies the signal to the downstream control unit for the drafting arrangement 1.

Figure 10:
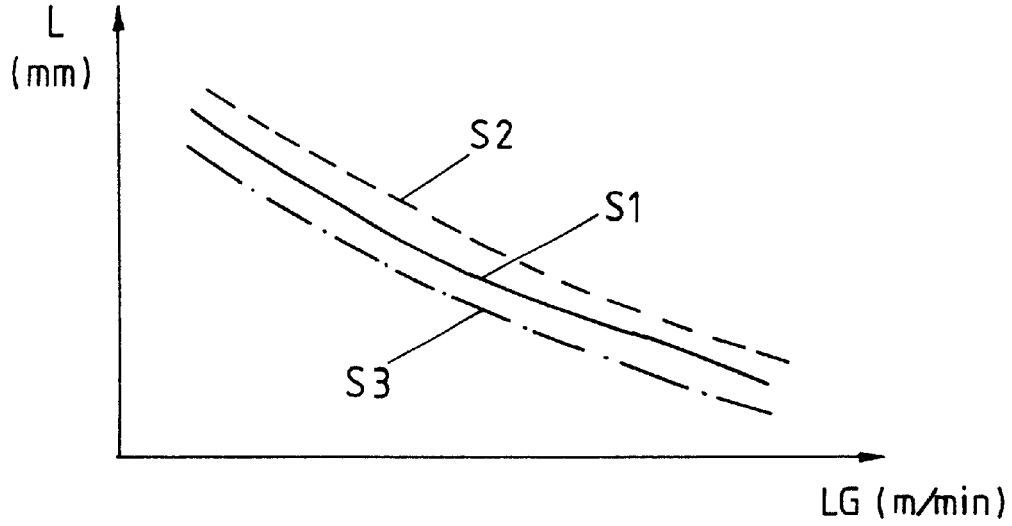
FIG. 10 shows a further diagram according to FIG. 9 for different materials.

FIG. 10 shows a further diagram (the inclusion of specific numbers was omitted) where separate curves S1 to S3 are shown for different materials (staple, type of cotton, etc.) in order to determine the position of the control application point R for the respective material on the basis of the delivery speed LG. In this case, the applicable selection of material is manually entered beforehand.

Further embodiments are also possible, in particular in the arrangement of the drive of the drafting arrangement 1. The invention is not limited to the combination of a carding machine and a draw frame. It is also possible to provide other machines upstream of the draw frame. The invention will be used essentially in cases when textile-processing machines are provided upstream of the drafting arrangement unit which are provided with larger fluctuations in production and thus in the delivery speed.

It should be apparent to those skilled in the art that various modifications and variations can be made to the embodiments of the invention described herein without departing from the scope and spirit of the invention as set forth in the appended claims and their equivalents.

What is claimed is:

1. A method to control drafting of a fiber mixture of a textile machine, with means being provided which detect fluctuations in mass of the fiber mixture which is supplied to a drafting arrangement unit comprising at least one changeable drafting zone which compensates for the fluctuations in mass, and a delay time being provided in order to take into account running time of the fiber mixture from a measuring element up to a control application point, wherein in that for changing certain control parameters delivery speed of the fiber mixture and comparison of the measured progress of the mass of the fiber material supplied by the drafting arrangement unit with a predetermined setpoint progress of mass are used;

wherein positioning of the control application point to the measuring element is corrected depending on the delivery speed of the fiber mixture; and wherein distance from the control application point to the measuring element is reduced with rising delivery speed.

2. A method to control drafting of a fiber mixture of a textile machine, with means being provided which detect fluctuations in mass of the fiber mixture which is supplied to a drafting arrangement unit comprising at least one changeable drafting zone which compensates for the fluctuations in mass, and a delay time being provided in order to take into account running time of the fiber mixture from a measuring element up to a control application point, wherein in that for changing certain control parameters delivery speed of the fiber mixture and comparison of the measured progress of the mass of the fiber material supplied by the drafting arrangement unit with a predetermined setpoint progress of mass are used;

wherein positioning of the control application point to the measuring element is corrected depending on the delivery speed of the fiber mixture;

wherein a corrective factor for the change in the position of the control application point is taken from a curve which is predetermined to a control unit; and wherein several preselectable curves according to different fiber materials are stored in the control unit.

3. A method to control drafting of a fiber mixture of a textile machine, with means being provided which detect fluctuations in mass of the fiber mixture which is supplied to a drafting arrangement unit comprising at least one changeable drafting zone which compensates for the fluctuations in mass, and a delay time being provided in order to take into account running time of the fiber mixture from a measuring element up to a control application point, wherein in that for changing certain control parameters delivery speed of the fiber mixture and comparison of the measured progress of the mass of the fiber material supplied by the drafting arrangement unit with a predetermined setpoint progress of mass are used;

wherein positioning of the control application point to the measuring element is corrected depending on the delivery speed of the fiber mixture; and wherein the change of the position of the control application point only occurs when the delivery speed of the fiber mixture leaves a predetermined tolerance threshold.

4. A method to control drafting of a fiber mixture of a textile machine, with means being provided which detect fluctuations in mass of the fiber mixture which is supplied to a drafting arrangement unit comprising at least one changeable drafting zone which compensates for the fluctuations in mass, and a delay time being provided in order to take into account running time of the fiber mixture from a measuring element up to a control application point, wherein in that for changing certain control parameters delivery speed of the fiber mixture and comparison of the measured progress of the mass of the fiber material supplied by the drafting arrangement unit with a predetermined setpoint progress of mass are used;

wherein the comparison between the measured course of the mass of the fiber material as supplied by the drafting arrangement unit with the predetermined setpoint course of mass, deviations which exceed a tolerance value are used for changing the control parameters; and wherein the course of the mass is depicted in the form of a spectrogram which is compared with a standard spectrogram which is predetermined to the control unit.

5. The method as claimed in claim 4, wherein the spectrogram deviations are used in the range of between 5 and 150 cm periodic lengths.

6. The method as claimed in claim 4, wherein in that for setting the control parameters the fiber mass supplied to the drafting arrangement unit is changed per measuring interval.

7. The method as claimed in claim 4, wherein a coefficient of variation of the predetermined setpoint course of the mass is compared with a coefficient of variation value of the measured actual mass and is used for setting the control parameters.

8. The method as claimed in claim 7, wherein the length CV value with lengths of cut of between 20 cm and 3 m is used.

9. The method as claimed in claim 4, wherein the fiber mixture from a carding machine is supplied to the drafting arrangement unit.

10. The method as claimed in claim 9, wherein during run-up of the carding machine a warm-up period is set during which certain monitorings of the control unit are ceased.

11. The method as claimed in claim 10, wherein the warm-up period is monitored by temperature sensors.

12. The method as claimed in claim 11, wherein the warm-up period is determined with respect to time.

13. A method to control drafting of a fiber mixture of a textile machine, with means being provided which detect fluctuations in mass of the fiber mixture which is supplied to a drafting arrangement unit comprising at least one changeable drafting zone which compensates for the fluctuations in mass, and a delay time being provided in order to take into account running time of the fiber mixture from a measuring element up to a control application point, wherein in that for changing certain control parameters delivery speed of the fiber mixture and comparison of the measured progress of the mass of the fiber material supplied by the drafting arrangement unit with a predetermined setpoint progress of mass are used;

wherein the comparison between the measured course of the mass of the fiber material as supplied by the drafting arrangement unit with the predetermined setpoint course of mass, deviations which exceed a tolerance value are used for changing the control parameters; and wherein the course of the mass is depicted as a mean value which is compared with a predetermined setpoint mean value.

14. A method to control drafting of a fiber mixture of a textile machine, with means being provided which detect fluctuations in mass of the fiber mixture which is supplied to a drafting arrangement unit comprising at least one changeable drafting zone which compensates for the fluctuations in mass, and a delay time being provided in order to take into account running time of the fiber mixture from a measuring element up to a control application point, wherein in that for changing certain control parameters delivery speed of the fiber mixture and comparison of the measured progress of the mass of the fiber material supplied by the drafting arrangement unit with a predetermined setpoint progress of mass are used;

wherein the comparison between the measured course of the mass of the fiber material as supplied by the drafting arrangement unit with the predetermined setpoint course of mass, deviations which exceed a tolerance value are used for changing the control parameters; and wherein the control application point is displaced for the correction of the deviation in the mass.

15. An apparatus to control the draft of a fiber mixture which is supplied by a textile machine to a downstream drafting arrangement unit, a measuring element being provided which detects fluctuations in mass of the fiber mixture which is supplied to a drafting arrangement unit and the drafting arrangement unit is equipped with at least one changeable drafting zone which compensates the fluctuations in mass and whose draft quantity is controlled via a control unit on the basis of the determined fluctuations in the mass in comparison with a predetermined setpoint value and on the basis of a delay time between the measuring element and a control application point, wherein means are provided with which a position from the control application point to the measuring element is determined on the basis of delivery speed of the fiber mixture; and wherein the fiber material is supplied from a carding machine to a downstream drafting arrangement unit and the control unit of the carding machine is equipped with means to transmit a corrective signal to determine the position of the control application point of the downstream drafting arrangement unit to the control unit of the drafting arrangement order to initiate a change in the draft.

16. An apparatus to control the draft of a fiber mixture which is supplied by a textile machine to a downstream drafting arrangement unit, with means being provided which detect fluctuations in mass of the fiber mixture which is supplied to a drafting arrangement unit and the drafting arrangement unit is equipped with at least one changeable drafting zone which compensates the fluctuations in mass and whose draft quantity is controlled via a control unit on the basis of the determined fluctuations in the mass in comparison with a predetermined setpoint value and on the basis of a delay time between the measuring location and a control application point, wherein in that at least one further means is provided in order to detect a course of the mass of the fiber material as supplied by the drafting arrangement unit and signals of the means are supplied to the control unit which determines deviations on the basis of a predetermined setpoint value and produces control signals according to the deviations in order to change certain control parameters; and wherein in that for the purpose of setting the control parameters a quantity of supplied fiber mass by the carding machine is varied for different measuring periods.

17. The apparatus as claimed in claim 16, wherein in that speed of a feed roller to the carding machine is constant and speed of a doffer is changed by the control unit.

18. The apparatus as claimed in claim 17, wherein a timing element is provided in order to consider the delay time between the start of an altered delivery quantity and the time at which the changed delivery quantity is processed in the drafting arrangement unit.

19. The apparatus as claimed in claim 16, wherein speed of a feed roller to the carding machine is changed by the control unit and speed of a doffer is kept constant.

20. An apparatus to control the draft of a fiber mixture which is supplied by a textile machine to a downstream drafting arrangement unit, with means being provided which detect fluctuations in mass of the fiber mixture which is supplied to a drafting arrangement unit and the drafting arrangement unit is equipped with at least one changeable drafting zone which compensates the fluctuations in mass and whose draft quantity is controlled via a control unit on the basis of the determined fluctuations in the mass in comparison with a predetermined setpoint value and on the basis of a delay time between the measuring location and a control application point, wherein in that at least one further means is provided in order to detect a course of the mass of the fiber material as supplied by the drafting arrangement unit and signals of the means are supplied to the control unit which determines deviations on the basis of a predetermined setpoint value and produces control signals according to the deviations in order to change certain control parameters; and wherein during run-up of the carding machine a warm-up function is initiated by the control unit for the machine which deactivates certain means for monitoring.

21. The apparatus as claimed in claim 20, wherein means for monitoring the warm-up period are provided by means of which the initiation for setting the control parameters is released.

22. The apparatus as claimed in claim 21, wherein the means are temperature sensors which are attached to the carding machine or the drafting arrangement unit.

23. A method for controlling drafting of fiber material in a textile machine wherein the textile machine is provided with a device for sensing fluctuations in fiber material mass and a drafting arrangement in communication with the sensing device to compensate for the mass fluctuations, the drafting arrangement having a changeable drafting zone defining a control application point of the drafting process, said method comprising determining changes in the position of the control application point as a function of changes in delivery speed of the fiber material and varying at least one control parameter of the drafting process to compensate for the change in position of the control application point, and comparing a measured progress of the fiber material mass to a predetermined setpoint progress of mass to change parameters of the drafting.

24. The method as in claim 23, wherein the time delay between when the fiber mass fluctuations are sensed at the sensing device and when corresponding drafting changes are made in the drafting zone is changed as a function of the change in position of the control application point.

25. The method as in claim 24, wherein a correction factor is determined for the change in the control application point from data stored in a control unit.

26. The method as in claim 25, wherein the data is in the form of a correction curve correlating delivery speed to distance of the control application point from the sensing point of the sensing device.

27. The method as in claim 25, wherein data is stored in the control unit for different types of fiber material that may be processed by the textile machine.

28. The method as in claim 24, wherein the control application point is varied by decreasing the distance from the control application point to the sensing point of the sensing device as the delivery speed of the fiber material increases.

29. The method as in claim 24, wherein the control application point is varied upon changes in the delivery speed of the fiber material exceeding a tolerance threshold range.

30. The method as in claim 23, wherein the fiber material is supplied to the drafting arrangement from a carding machine.

31. The method as in claim 30, further comprising establishing a warm-up period for the carding machine wherein the position of the control application point is not varied.

32. The method as in claim 31, wherein the warm-up period is determined as a function of temperature of a component of the carding machine.

33. The method as in claim 31, wherein the warm-up period is determined as a function of running timer of the carding machine.

34. A method for controlling drafting of fiber material in a textile machine wherein the textile machine is provided with a device for sensing fluctuations in fiber material mass and a drafting arrangement in communication with the sensing device to compensate for the mass fluctuations, the drafting arrangement having a changeable drafting zone defining a control application point of the drafting process, said method comprising varying a control parameter of the drafting process as a function of a comparison of an actual measured progress of the fiber material mass supplied by the drafting arrangement with a standard setpoint progress of the fiber material mass.

35. The method as in claim 34, wherein any combination of the following control parameters are varied as a function of the comparison of the actual measured progress of the fiber material mass: magnitude of draft; displacement of the control application point of drafting in the drafting zone; changes in contact pressure of drafting pressure rollers; and changes in drafting distance.

36. The method as claim 34, wherein the control application point of drafting in the drafting zone is varied when the comparison of the actual measured progress of the fiber material mass with the setpoint progress of the fiber material mass exceeds a tolerance threshold range.

37. The method as in claim 34, wherein the actual measured progress of the fiber material mass is determined in the form of a spectrogram and the setpoint progress of the fiber material mass is stored as a standard spectrogram.

38. The method as in claim 37, wherein spectrogram deviations are used in the range of between about 5 and about 150 cm periodic lengths.

39. The method as in claim 34, wherein the actual measured progress of the fiber material mass is determined as a mean value and the setpoint progress of the fiber material mass is stored as a setpoint mean value.

40. The method as in claim 34, further comprising comparing the CV value of the actual measured progress of the fiber material mass with the CV value of the setpoint measured progress of the fiber material mass.

41. The method as in claim 34, wherein the fiber material is supplied to the drafting arrangement from a carding machine.

42. The method as in claim 41, further comprising establishing a warmup period for the carding machine wherein the position of the control application point is not varied.

43. The method as in claim 42, wherein the warm-up period is determined as a function of temperature of a component of the carding machine.

44. The method as in claim 42, wherein the warm-up period is determined as a function of running time of the carding machine.

45. An apparatus for controlling drafting of fiber material in a textile machine, comprising:

a measuring element for detecting fluctuations in mass of the fiber which is supplied to a drafting arrangement unit;

the drafting arrangement unit having at least one changeable drafting zone to compensate for mass fluctuations;

a control unit for controlling draft on the basis of fluctuations in mass in comparison with a predetermined setpoint value an on the basis of a delay time between the measuring element and a control application point, the control application point is located a certain distance from the measuring element; and the control unit controls the distance from the control application point to the measuring element by evaluating the delivery speed of the fiber, and the control unit changes parameters of the drafting unit based on a comparison of a measured progress of the fiber mass to a predetermined setpoint progress of mass.

46. The apparatus as set forth in claim 41, wherein the control unit has a microcomputer which changes the draft of the drafting arrangement unit by evaluating data stored in the control unit and signals delivered to the control unit by the measuring element.

47. An apparatus for controlling drafting of fiber material in a textile machine, comprising:

a measuring element for detecting fluctuations in mass of the fiber which is supplied to a drafting arrangement unit;

the drafting arrangement unit having at least one changeable drafting zone to compensate for mass fluctuations;

a control unit for controlling draft on the bass of fluctuations in mass in comparison with a predetermined setpoint value and on the basis of a delay time between the measuring element and a control application point, the control application point is located a certain distance from the measuring element, the control unit changes parameters of the drafting unit based on a comparison of a measured progress of the fiber mass to a predetermined setpoint progress of mass; and a sensor downstream of the drafting arrangement unit, the sensor detects the mass of the fiber and provides signals to the control unit which are used in combination with signals from the measuring element to determine a new distance from the control application point to the measuring element.

48. The apparatus as set forth in claim 47, wherein the textile machine is a carding machine.

* * * * *